US006569073B1

(12) United States Patent
Bridges et al.

(10) Patent No.: US 6,569,073 B1
(45) Date of Patent: May 27, 2003

(54) TELESCOPING PLATFORM ASSEMBLY FOR PACKAGING SYSTEMS

(75) Inventors: John William Bridges, Pflugerville, TX (US); James Edwin Manuel, Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 132 days.

(21) Appl. No.: 09/666,506

(22) Filed: Sep. 20, 2000

(51) Int. Cl.[7] ..... B31B 1/50

(52) U.S. Cl. ..... 493/183; 493/52; 493/70; 493/80; 493/245; 493/260

(58) Field of Search ..... 493/183, 52, 70, 493/80, 93, 113, 140, 171, 245, 260; 206/583, 586, 523

(56) References Cited

U.S. PATENT DOCUMENTS 4,211,356 A * 7/1980 Tsuchiya et al. ..... 206/586
4,368,840 A * 1/1983 Pardo
4,709,817 A * 12/1987 Keady et al. ..... 206/523
5,110,037 A * 5/1992 Pieritz ..... 493/183
5,143,282 A * 9/1992 Pham
5,226,542 A * 7/1993 Boecker et al. ..... 206/583
6,113,525 A * 9/2000 Waechter ..... 193/183
6,226,965 B1 * 5/2001 Lam ..... 193/183

* cited by examiner

*Primary Examiner*—Eugene Kim
*Assistant Examiner*—Sameh Tawfik
(74) *Attorney, Agent, or Firm*—Rafael V. Baca; Shaffer & Culbertson, L.L.P.

(57) ABSTRACT

A packaging system (1) includes a telescoping platform assembly (100) having a guide mount (30) and an extension platform (40). The packaging system (1) incorporating the telescoping platform assembly (100) includes a panel (22) and a flap member (26). The flap member (26) is connected to the panel (22) along a pivot axis (27) and is adapted to move between a first position with respect to the panel (22) and a second position with respect to the panel (22). The guide mount (30) includes a guide mount slot (33) whereas the flap member (26) includes a flap guide slot (28) extending outwardly from the pivot axis (27) through the flap member (26). The extension platform (40) is mounted on the guide mount (30) and the flap member (26) and is adapted to slide between a stowed position and a deployed position along guide mount slot (33) and the flap guide slot (28). In the deployed position, the extension platform (40) extends over an outer edge (26*c*) of the flap member (26) to increase the effective length of the flap member (26).

15 Claims, 5 Drawing Sheets

TELESCOPING PLATFORM ASSEMBLY FOR PACKAGING SYSTEMS

TECHNICAL FIELD OF THE INVENTION

The present invention generally relates to packaging systems. More particularly, the invention relates to an apparatus and method for increasing the effective length of flaps used in packaging systems.

BACKGROUND OF THE INVENTION

Computer systems and other electronic systems are commonly shipped as several separate components packaged in a single shipping box or container. The separate components may include the computer chassis and its associated enclosure, a keyboard, a mouse, and system software and documentation. The computer chassis may be loaded into a protective sling within the main box. This sling may have a bottom panel, at least two side panels, and two sling flaps, one sling flap connected to each side panel. The sling flaps fold or pivot with respect to the respective side panel to an open position in which the chassis may be placed in the sling. Once the chassis is loaded, the sling flaps are folded down to a closed position to partially cover and secure the chassis in a well-protected position in the main box. Although a gap remains between the sling flaps when they are folded down to the closed position, additional padding or spacing elements, or smaller boxes containing the other system components may be placed on the sling flaps to fill the volume of the main box remaining above the sling and previously loaded chassis.

In all packaging systems, particularly computer packaging systems, the speed at which the products may be packaged and readied for shipping is critical. All components of the packaging system, including the main box and any protective sling or other packaging components must be easy to load, close, and prepare for shipping. Difficulties or inefficiencies in the packaging system can reduce the number of units which may be packaged and shipped in a given period, and thus reduce overall productivity.

In the situation where additional components are placed in a main box above a sling, it is important that the components do not fall in the gap left between the sling flaps when the sling flaps are folded down in the closed position. Components that fall between the sling flaps may become damaged or damage other components previously packaged in the sling assembly. This is particularly the case where smaller components become loose as the shipping box is moved about during shipping.

For example, a computer system may include any one of several different keyboards, each different keyboard having a different size and shape and being shipped in a keyboard box shaped differently than the boxes required for the other keyboards. Although the keyboard box sizes may vary, it is desirable to use a standard packaging system, including a standard shipping box and sling size for packaging each computer system. However, a smaller sized keyboard box placed on the standard sized sling flaps may slide off at least one of the sling flaps and become loose in the packaging system.

One potential solution is to have an array of differently sized packaging systems each system designed for a specific combination of components. However, it is costly to manufacture and inventory an array of packaging systems for each possible combination of computer system components which may be ordered by a customer. Having an array of different packaging systems also increases the labor costs associated with packaging a system since the packager must take the time to match the right packaging system with the components for which it is suitable.

In a packaging system utilizing a sling or similar packaging device, it is therefore desirable to provide some mechanism for enabling the closed sling flaps to securely receive components of various sizes. More specifically, it is desirable to provide a mechanism for improving loading capability of a sling flap by increasing the effective length of the sling flap. An increased effective length, allows a wider range of component box sizes to be secured above the sling or similar packaging device.

SUMMARY OF THE INVENTION

It is an object of the present invention to provide a telescoping platform assembly and a method for increasing the effective length of a flap member via the telescoping platform assembly. Another object of the invention is to provide a packaging system utilizing a telescoping platform assembly.

In accordance with the present invention, a packaging device includes a flap member connected to a panel along a pivot axis. The flap member is adapted to pivot about the pivot axis between a first position with respect to the panel and a second position with respect to the panel. For example, the first position may comprise an open position for the flap member while the second position may comprise a closed position for the flap member. According to the invention, a telescoping platform assembly is mounted on the flap member. The telescoping platform assembly is adapted to move automatically from a retracted position to an extended position as the flap is moved from the open to closed position with respect to the panel. In the extended position, the telescoping platform assembly increases the effective length of the flap member.

The telescoping platform assembly includes an extension platform and a guide mount. The guide mount is mounted on the flap member and the extension platform is sizeably mounted on the guide mount. According to the invention, the extension platform slides between a stowed position and a deployed position with respect to the guide mount. The deployed position of the extension platform corresponds to the extended position of the telescoping platform assembly, while the stowed position of the extension platform corresponds to the retracted position of the telescoping platform assembly. In its deployed position, the extension platform extends a maximum distance from the pivot axis to thus increase the effective length of the flap member.

The guide mount includes a guide mount slot whereas the flap member includes a flap guide slot extending outwardly from the pivot axis. The guide mount portion of the telescoping platform assembly is mounted on the flap member so that the guide mount slot is aligned with the flap guide slot. The extension platform portion of the telescoping platform assembly is mounted on the guide mount and the flap member. Specifically, the extension platform slides between the stowed position and the deployed position along the guide mount slot and the flap guide slot. In addition, the extension platform may slide completely off the guide mount slot and the flap guide slot. Removing the extension platform entirely from the flap member in this fashion allows relatively larger boxes to fit above the flap member when the flap member is in the closed position.

The extension platform includes a driver component for contacting the panel when the flap member is in the second, closed position. As the flap member moves from the first to the second position, the driver component contacts the panel. The force exerted on the driver component by the panel drives the extension platform outwardly from the guide mount to ultimately assume the deployed position.

The invention may be incorporated in a packaging system including a container and a sling assembly adapted to be received in the container. One or more side panels may be included in the sling assembly, with each side panel having an associated flap which is adapted to fold from an open first position to a closed second position. One or more separate telescoping platform assemblies according to the invention may be associated with each flap in this container/sling assembly packaging system, enabling the packaging system to accommodate many different types of components or other objects above the sling assembly.

The present telescoping platform assembly increases the effective length of the flap member with respect to the pivot axis of the flap member. When used in the sling assembly/container packaging system, the telescoping platform assembly extends the effective length of the flap member so that additional packages may be easily added on top of the closed flap member. In particular, the increased effective length allows relatively smaller boxes to be properly supported in the container above the sling. The telescoping platform assembly may also be used to increase the effective height of the flap member, allowing the flap member to better support relatively narrow or short packages. Furthermore, the present telescoping platform assembly may be easily incorporated into existing sling assembly designs and other packaging device designs.

These and other objects, advantages, and features of the invention will be apparent from the following description of the preferred embodiments, considered along with the accompanying drawings.

DESCRIPTION OF THE PREFERRED EMBODIMENTS

Figure 1:
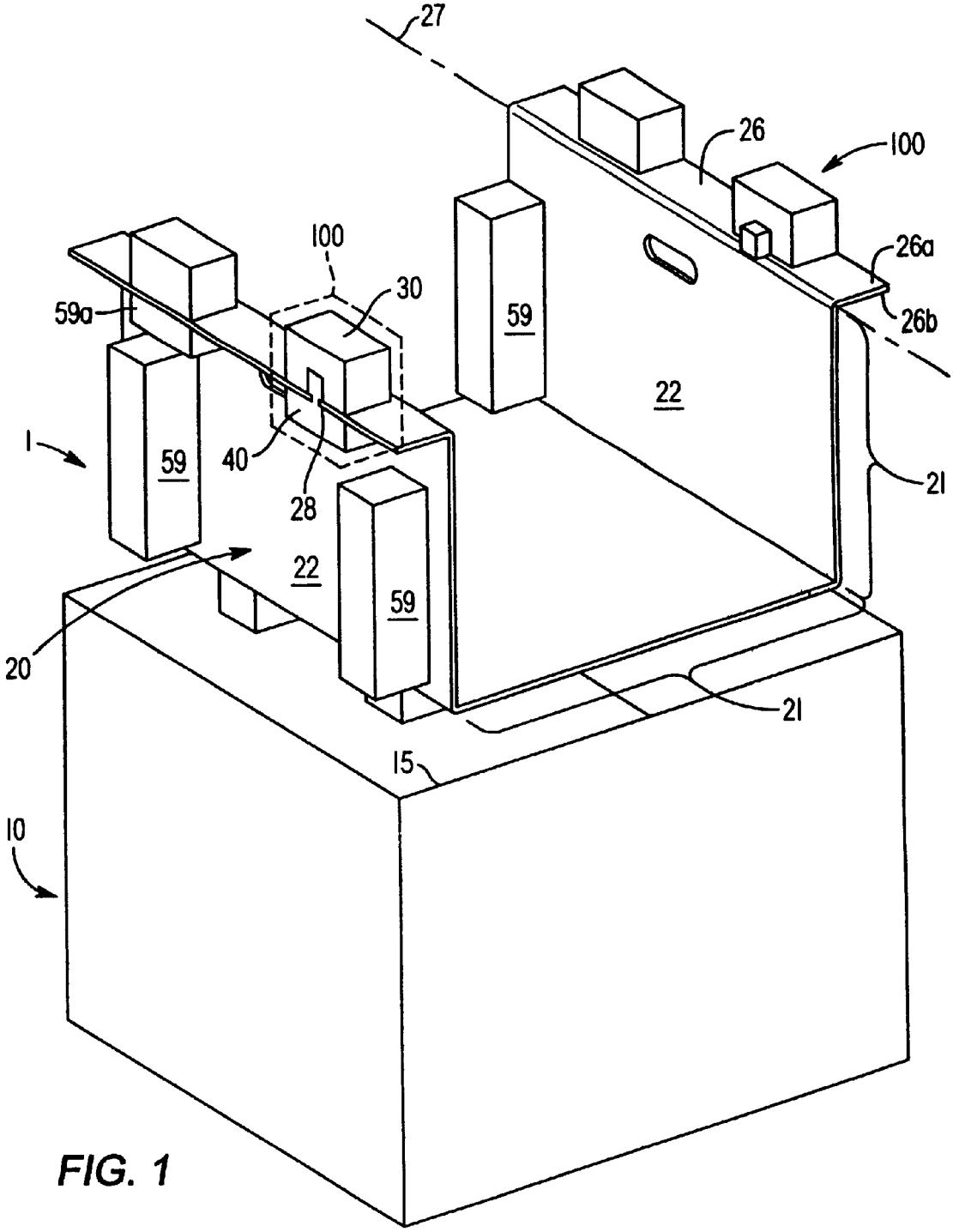
FIG. 1 is an exploded isometric view illustrating a packaging system including a container and a sling assembly, the sling assembly featuring telescoping platform assemblies according to one preferred form of the invention.

FIG. 1 illustrates a packaging system 1 incorporating a telescoping platform assembly 100 embodying the principles of the invention. The packaging system 1 includes a container 10 and a sling assembly 20 adapted to be received within the container 10.

The container 10 is defined by a series of walls 15 and provides a convenient receptacle for receiving various components which may be shipped together. In the preferred embodiment, the container 10 comprises a shipping container, such as a container for shipping computer systems. The container 10 is sufficiently sized to enclose the sling assembly 20 and, preferably, additional packages or objects which may be shipped together with an object held in the sling assembly 20. For example, the container 10 may be adapted to contain various smaller components of a computer system such as the keyboard, mouse, and system documentation in the volume of the container above the sling assembly.

The sling assembly 20 is provided for receiving an object to be shipped within the container 10, and holding the object in a well-protected and stable position within the container 10. The illustrated sling assembly 20 includes two panels 22, each with a flap member 26. Each flap member 26 is connected to the respective panel 22 and is adapted to move between a first position and a second position with respect to the panel 22. The sling assembly 20 defines an inner sling compartment 21 generally between the panels 22.

Figure 5:
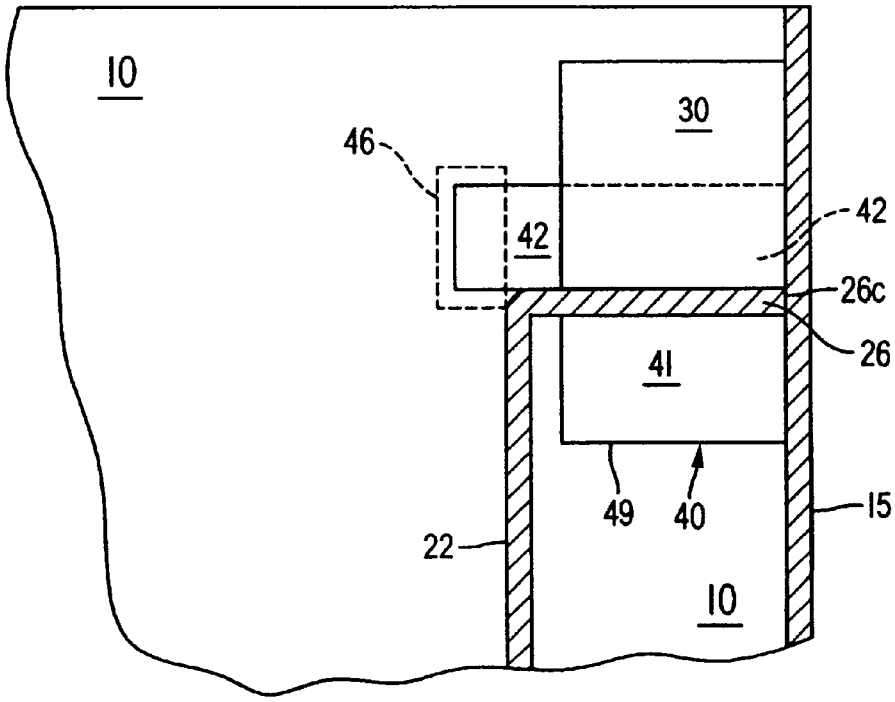
FIG. 5 is an enlarged side view of a flap member and telescoping platform assembly as shown in FIG. 1, with the flap member in a first or open position and the telescoping platform assembly in the retracted position.
Figure 6:
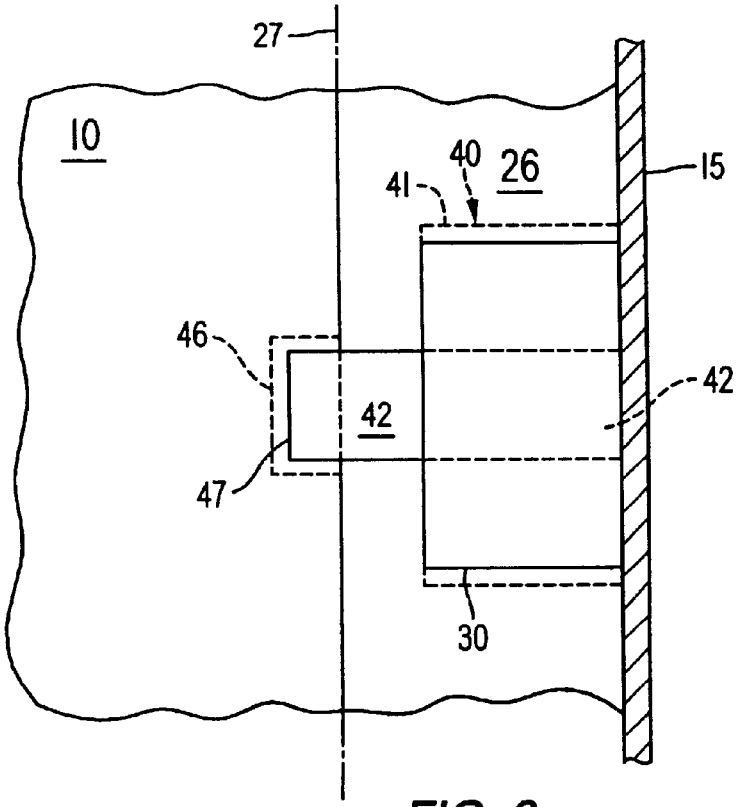
FIG. 6 is a top plan view of the telescoping platform assembly in the position shown in FIG. 5.

FIG. 1 shows the flap members 26 both in the first or open position with respect to the their respective panel 22. FIGS. 5 and 6 show further details of the flap member 26 arranged in the first position. As shown best in FIGS. 5 and 6, the flap member 26 is so dimensioned that when it is in the first position extending generally perpendicular to the panel 22 in the area between the panel and the container wall 15, the outer edge **26*c* of the flap member contacts the container wall 15. This contact holds the flap member 26 in the first or open position with the inner sling compartment 21 completely exposed so that objects may be loaded into the sling assembly 20**.

Figure 7:
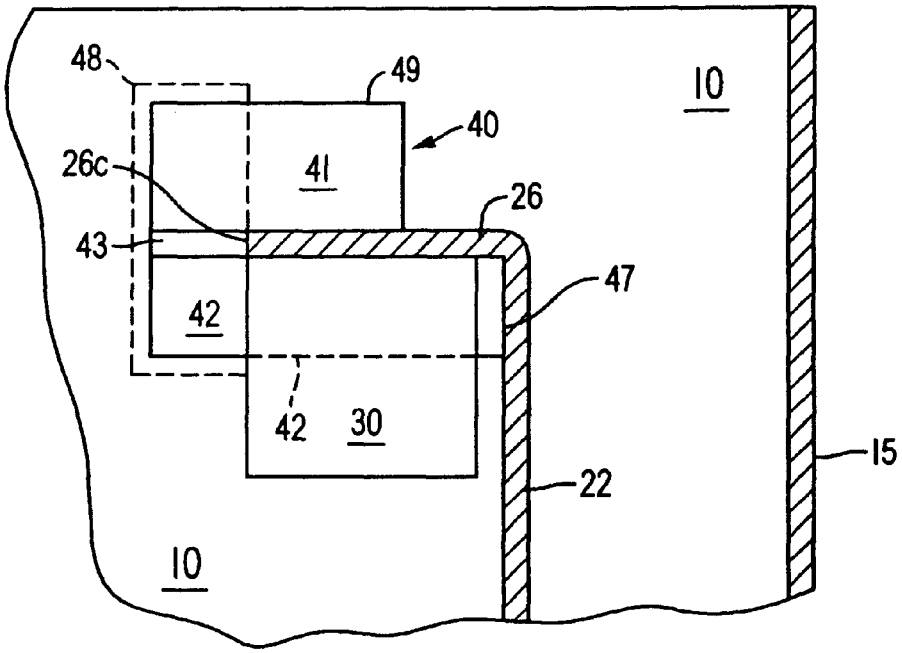
FIG. 7 is a side view similar to FIG. 5 but with the flap member in a second or closed position and with the telescoping platform assembly in the extended position.
Figure 8:
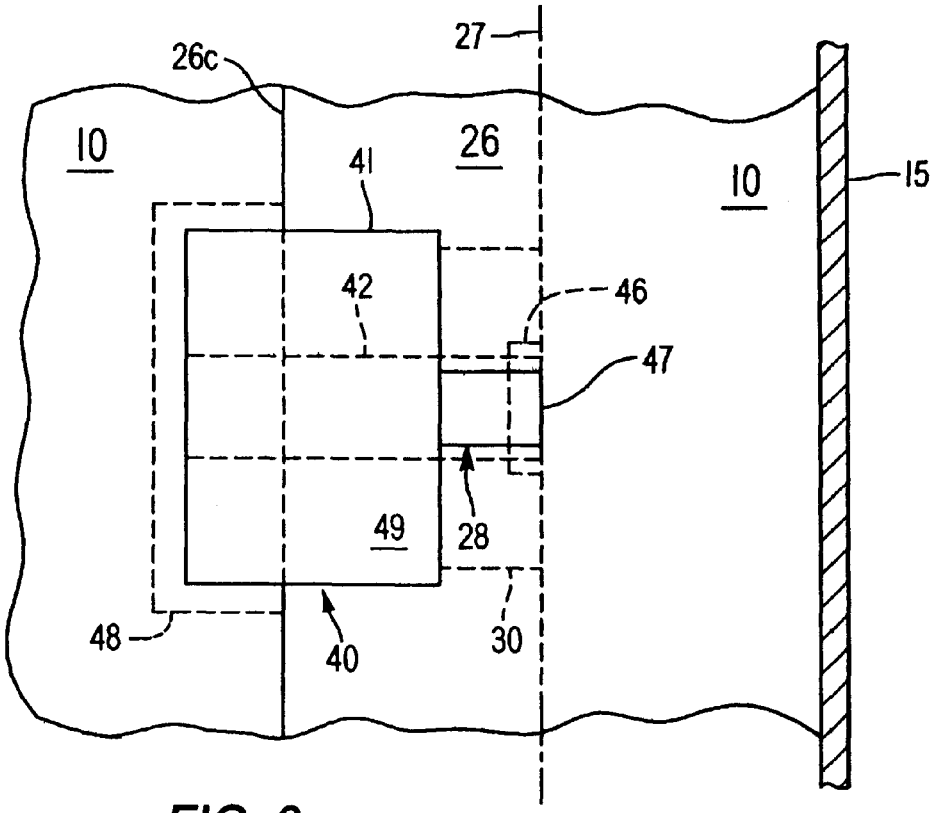
FIG. 8 is a top plan view of the telescoping platform assembly in the position shown in FIG. 7.

FIGS. 7 and 8 show the flap member 26 arranged in the second or closed position. In this second position, the flap member 26 extends generally perpendicularly from the panel 22 over the inner sling compartment 21 in position for securing objects within the inner sling compartment. The flap members 26 in the second, closed position also create a partial platform for receiving objects above the sling assembly 20. So long as each object is not small enough to slide from the flap members 26 and fall into the inner sling compartment 21 through the gap between the closed flap members, the flap members 26 in the second position permit storage of additional objects in the container 10 above those objects stored within the sling assembly 20.

As shown in FIG. 1, a separate telescoping platform assembly 100 according to the invention is mounted on each flap member 26. As shown in FIG. 5, the telescoping platform assembly 100 resides in a retracted position with respect to the flap member 26 when the flap member is in the first or open position. As shown in FIGS. 7 and 8, the telescoping platform assembly 100 resides in an extended position when the flap member 26 is in the second or closed position. In its extended position, the telescoping platform assembly 100 increases the effective length of a flap member 26 so that smaller sized objects may be accommodated above the sling assembly 20 without the danger of their falling into the inner sling compartment 21. Yet the telescoping platform assembly 100 does not interfere with the contact between the flap member 26 and container wall 15 which holds the flap member in the desired first or open position.

In addition to its use in a sling assembly, those of ordinary skill in the art will appreciate that a telescoping platform assembly 100 according to the invention may be used in any other packaging device which includes a panel along with a flap which is adapted to move between various positions with respect to the panel. For example, a telescoping platform assembly embodying the principles of the invention may be provided for an inner flap within a box so that the telescoping platform assembly ultimately permits stacking of additional items within the box.

As indicated in FIG. 1, the sling assembly 20 includes a single piece of material, such as corrugated cardboard for example, folded to form the panels 22 and flap members 26. Each flap member 26 may pivot with respect to the corresponding panel 22 by folding along a pivot edge between the panel and flap member. This pivotal connection between the panel 22 and the flap member 26 thus defines a pivot axis 27 indicated in FIGS. 1, 3, 6, and 8. Other embodiments of the invention contemplate the panels 22 and the flap members 26 as separate elements that are connected to form the sling assembly 20 by standard methods for connecting. For example, the panels 22 may be connected to a bottom member of the sling assembly 20 by adhesive tape, a hinge, or a mortise and tenon joint. Each flap member 26 may be connected to the respective panel 22 by adhesive tape, a hinge, or any other structure which enables the flap member 26 to pivot from a first position to a second position with respect to the corresponding panel 22.

Figure 2:
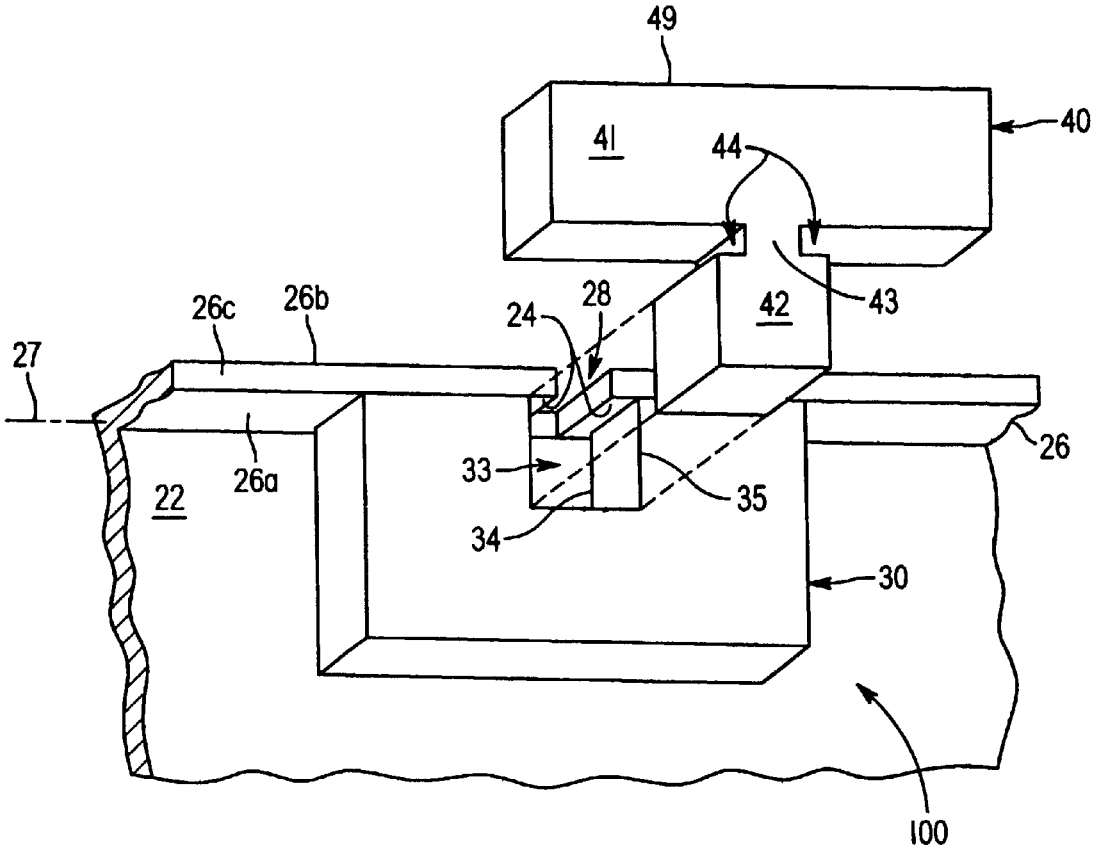
FIG. 2 is an enlarged isometric view illustrating a telescoping platform assembly shown in FIG. 1, with an extension platform portion of the assembly exploded from a guide mount portion of the telescoping platform assembly.

As shown best in FIGS. 1 and 2, the telescoping platform assembly 100 includes a guide mount shown generally as reference numeral 30 and an extension platform shown at reference numeral 40. The extension platform 40 slides between a stowed position and a deployed position along the guide mount 30. Specifically, the extension platform 40 resides in the deployed position shown in FIGS. 7 and 8 when the overall telescoping platform assembly 100 is in the extended position and the flap member 26 is in the second or closed position. However, as shown in FIGS. 5 and 6 the extension platform 40 may reside in the stowed position when the telescoping platform assembly 100 is in the retracted position and the flap member 26 is in the first or open position.

As shown best by comparing the deployed extension platform position shown in FIGS. 7 and 8 with the stowed extension platform position shown in FIGS. 5 and 6, the extension platform 40 extends further from the pivot axis 27 in the deployed position as compared to the stowed position. In the deployed position, the extension platform 40 ultimately increases the effective length of the flap member 26 over the inner sling compartment 21. The increased effective length of the flap member 26 provided by the deployed extension platform 40 enhances loading capacity of the flap member by increasing the overall effective area of the partial platform created by each flap member as it extends over the inner sling compartment 21. A greater effective support area above the inner sling compartment accommodates relatively smaller objects without the danger of the objects falling through the gap between the flap members 26 and into the inner sling compartment. Moreover, the preferred extension platform 40 may slide completely off the guide mount 30. Removing the extension platform 40 entirely from the guide mount 30 allows larger objects to be loaded onto the flap member 26 above the sling assembly 20.

The illustrated sling assembly 20 preferably includes two telescoping platform assemblies 100, each assembly set on a respective flap member 26 and opposingly positioned from one another. Opposingly positioned is defined as the condition in which the extension platforms 40 extend toward each other from their respective flap 26 when the flaps are folded down to the closed or second position. In this opposing arrangement, the effective length of each flap member 26 over the inner sling compartment 21 is increased so as to minimize the gap between the closed flap members.

Although the preferred sling assembly 20 features two telescoping platform assemblies, those of ordinary skill in the art will appreciate that any number of telescoping platform assemblies may be positioned about a flap member to increase the effective reach of the flap member. Such telescoping assemblies positioned on opposite flap members need not be located directly across from each other as in the preferred embodiment shown in the figures.

The sling assembly 20 includes at least one spacer element 59, and preferably several spacer elements 59 arranged about the sling assembly 20. The spacer elements 59 are preferably made of a resilient material and positioned on the exterior of the sling to help hold the sling assembly 20 itself in a desired position within the container 10. Additional spacer elements 59 may also be included on the interior of the sling assembly 20 to help hold objects in a desired position within the sling assembly 20. The additional inner spacer elements 59 are dimensioned to hold an object in the inner sling compartment 21 at a predetermined position. Also, a flap spacer 59*a* may be provided to help stabilize an object above the closed flap members 26. The flap spacer 59*a* may extend the same dimension above the flap member 26 as the extension platform 40 and thus may be employed in conjunction with telescoping platform assemblies 100 to stabilize an object too wide to be supported by the two illustrated telescoping platform assemblies 100 alone.

As shown best in FIG. 2, the guide mount 30 includes a guide mount slot 33 extending through the guide mount 30 for slidably receiving the extension platform 40 between the stowed and the deployed position. The guide mount slot 33 extends through guide mount 30 from a first opening 34 to a second opening 35.

As shown in FIGS. 1 and 2, the flap member 26 includes a first or inner surface 26*a* and a second or outer surface 26*b*. The flap member 26 further includes a flap guide slot 28 extending outwardly from the pivot axis 27. The guide mount 30 is positioned on the first surface 26*a* of the flap member 26 so that the guide mount slot 33 is adjacent to and aligned with the flap guide slot 28.

In the preferred embodiment, the guide mount 30 is composed of a resilient material and is sized to contact an object in the sling when the flap member 26 is closed. Therefore, when the flap member 26 is in the closed, second position, the guide mount 30 helps stabilize an object within sling assembly 20 in a manner similar to an inner spacer element 59.

Referring now particularly to FIG. 2, the extension platform 40 includes a platform element 41 and a rider element 42 connected with the platform element 41. The platform element 41 includes a surface comprising a platform deck 49. When the extension platform 40 extends from the guide mount 30, the platform deck 49 moves along a plane that is parallel with the second surface 26*b* of the flap member 26. As described below, the platform deck 49 provides a surface for receiving an object thereon.

The rider element 42 is shaped to fit securely within, as well as slide along, the guide mount slot 33. The rider element 42 includes a driver component 46 (shown in a dashed box) also preferably made from a resilient foam material. As shown in FIGS. 5 and 6, the driver component 46 extends from the rider element 42 and protrudes over the pivot axis 27 and panel 22 when the extension platform 40 is in the stowed position with the flap member 26 in the open or first position.

The rider element 42 is connected to the platform element 41 via an intermediate member 43 positioned there between. The intermediate member 43 is sized to be received in and slide along the flap guide slot 28 of the flap member 26. The relative width of the intermediate member 43 with respect to the rider element 42 leaves at least one notch 44 adjacent to the intermediate member. In the illustrated form of the invention, notches 44 are positioned on either side of the intermediate member 43. Also, the relatively narrower width of the flap guide slot 28 with respect to the guide mount slot 33 leaves flap portions 24. These flap portions 24 function as rails which cooperate with notches 44 to retain the platform element 41 on guide mount 30 as the platform slides with respect to the guide mount.

Figure 3:
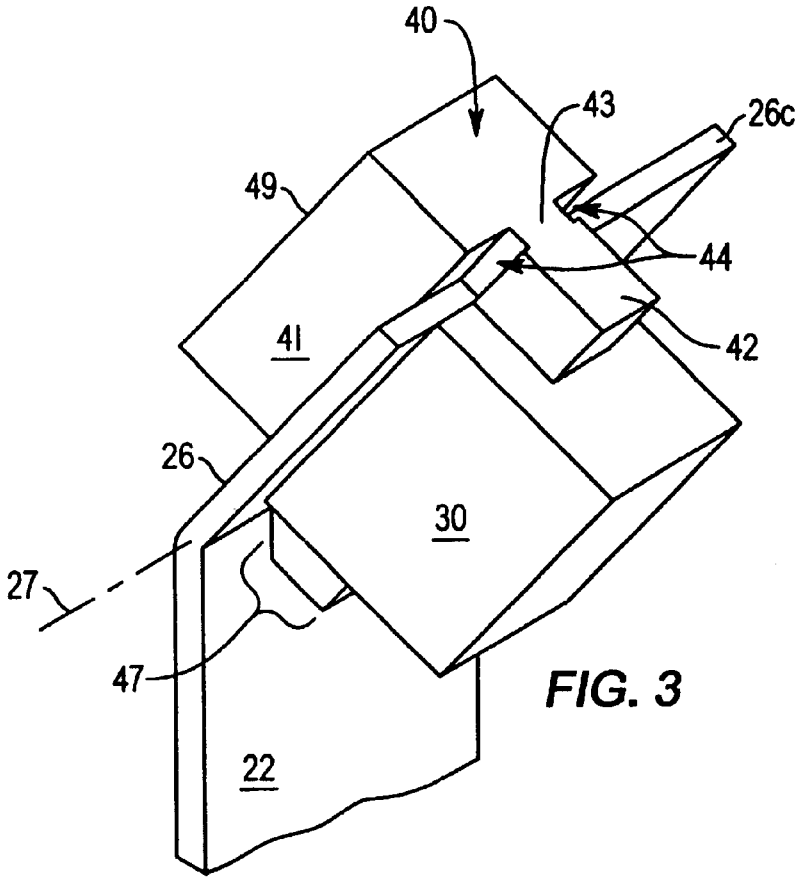
FIG. 3 is an isometric view of the telescoping platform assembly in an intermediate position between an extended and a retracted position.
Figure 4:
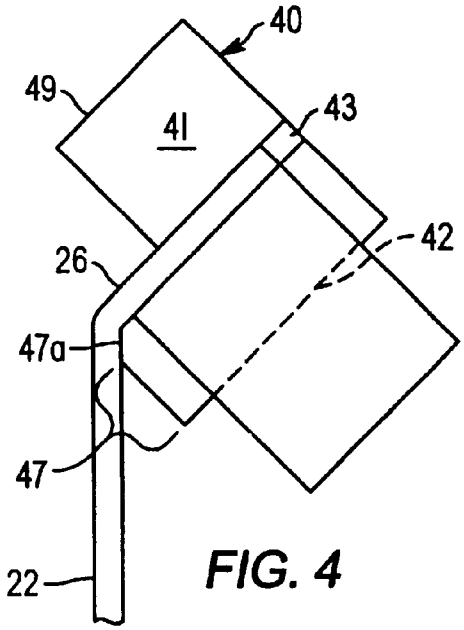
FIG. 4 is a side view of the telescoping platform assembly in the intermediate position shown in FIG. 3.

Referring now to FIGS. 3 and 4, as the flap member 26 moves from the open or first position to the closed or second position, the driver component 46 (FIGS. 5 and 6) contacts the panel 22 along a compression end 47 of the driver component, compressing a portion 47*a* of the driver component material. This force exerted on the compression end 47 by the panel 22 drives the rider portion 42 of the extension platform 40 outwardly from the guide mount 30 through the second opening 35 (FIG. 2) so that the extension platform 40 ultimately assumes the deployed position corresponding to the extended position of the telescoping platform assembly 100. Thus, the driver component 46 (FIGS. 5 and 6) functions as a linear actuator for pushing the rider portion 42 of the extension platform 40 through the guide mount slot 33 (FIG. 2).

In the extended position of the telescoping platform assembly shown in FIGS. 7 and 8, the compression end 47 of the driver component 46 rests against the panel 22 thereby ensuring that a portion of the extension platform 40 extends from the guide mount 30 to the deployed position. The portion of the platform element 41 that extends past the outer edge 26*c* of the flap member 26 is referenced in FIGS. 7 and 8 as a telescoping segment 48.

FIGS. 3–8 best show the operation of the preferred telescoping platform assembly. In FIGS. 5 and 6 the flap member 26 is in the first or open position to permit objects to be loaded into the inner sling compartment 21 of sling assembly 20. In this flap member position, the telescoping platform assembly 100 is in its retracted position, with the extension platform 40 in the stowed position. The driver component 46 extends outwardly from the guide mount slot 33 at the first opening 34 so as to protrude over the pivot axis 27 and above the inner sling compartment 21.

Each flap member 26 may then be moved from the first position to an intermediate position shown in FIGS. 3 and 4, and then ultimately to the second or closed position shown in FIGS. 7 and 8. As the flap member 26 is moved from the first position to the second position, the compression end 47 of driver component 46 contacts the panel 22 to drive the extension platform 40 outwardly from the guide mount 30 at the second opening 35.

When the flap member 26 is in the second or closed position shown in FIGS. 7 and 8, the flap member 26 forms a partial platform above the inner sling compartment 21. Because the extension platform 40 is in the deployed position, the telescoping segment 48 extends outwardly from the guide mount slot 33 so as to protrude over the outer edge 26*c* of the flap member 26 and above the inner sling compartment 21. In this position, the telescoping segment 48 is at a maximum distance from he pivot axis 27. Also, the compression end 47 of driver component 46 rests against the panel 22 to hold the platform element 40 in the deployed position.

As best shown in FIGS. 7 and 8, the telescoping assembly 100 in the extended position effectively increases the length of the flap member 26 on which it is mounted by the amount that the telescoping segment 48 extends past the outer edge 26*c* of the flap member. This reduces the overall distance between opposing flap members 26 and allows relatively smaller boxes to be loaded onto the flap members 26 in container 10 without the risk that the relatively smaller boxes will fall into the area between the flap members. Also, the width of the platform element 41 above the outer surface 26*b* (FIGS. 1 and 2) of the flap member has the effect of raising the partial platform provided by the closed flap members 26.

Although the present invention has been described in terms of the foregoing embodiment, such description has been for exemplary purposes only. As will be apparent to those of ordinary skill in the art, many alternatives, equivalents, and variations of varying degrees will fall within the scope of the present invention, and the following claims.

What is claimed is:

1. A packaging device for supporting an object within a second packaging device, the packaging device including:

(a) a product support structure including a panel;

(b) a flap member pivotally connected to the panel and adapted to move between a first position and a second position with respect to the panel; and (c) a telescoping platform assembly mounted on the flap member and adapted to move between a retracted position with respect to the flap member and an extended position with respect to the flap member.

2. The packaging device according to claim 1 further comprising:

(a) a pivot axis formed along the connection between the panel and the flap member.

3. The packaging device according to claim 2 wherein the flap member moves about the pivot axis between a first position and a second position with respect to the panel.

4. The packaging device according to claim 3 wherein the flap member includes:

(a) a flap guide slot extending outwardly from pivot axis toward an outer edge of the flap member.

5. The packaging device according to claim 4 wherein the telescoping platform assembly includes:

(a) a guide mount fixed to an inner surface of the flap member, the guide mount including a guide mount slot aligned with the flap guide slot.

6. The packaging device according to claim 5 wherein the telescoping platform assembly further includes:

(a) an extension platform mounted on the guide mount and the flap member, the extension platform being slidable along the guide mount slot and the flap guide slot between a stowed position and a deployed position.

7. The packaging device according to claim 6 wherein the extension platform includes:

(a) a driver component for contacting the panel in the second position of the flap member, thereby ensuring that the extension platform extends from the guide mount to the deployed position when the flap member is in the second position.

8. The packaging device according to claim 6 wherein the extension platform further includes:

(a) a platform deck coplanar with an outer surface of the flap member.

9. The packaging device according to claim 2 wherein the telescoping platform assembly includes:

(a) a telescoping segment that extends further from the pivot axis when the telescoping platform assembly is in the extended position as compared to the retracted position.

10. A packaging system comprising:

(a) a container;

(b) a sling assembly adapted to be received in the container, the sling assembly for receiving an object to be shipped in the container and for supporting the object in a desired position within the container;

(c) a panel included in the sling assembly;

(d) a flap member pivotally connected to the panel and adapted to move between a first position and a second position with respect to the panel; and (e) a telescoping platform assembly mounted on the flap member and adapted to move between a retracted position with respect to the flap member and an extended position with respect to the flap member when the flap member is moved from the first position to the second position.

11. The packaging system according to claim 10 further comprising:

(a) a pivot axis formed along the connection between the panel and the flap member.

12. The packaging system according to claim 11 wherein the telescoping platform assembly includes:

(a) a telescoping segment that extends further distant from the pivot axis when the telescoping assembly is in the extended position as compared with the retracted position.

13. The packaging system according to claim 10 wherein the telescoping platform assembly comprises foam material.

14. The packaging system according to claim 10 wherein the telescoping platform assembly includes:

(a) a guide mount mounted on the flap member and including a guide mount slot; and (b) an extension platform adapted to slide along the guide mount slot from a stowed position when the telescoping platform assembly is in the retracted position to a deployed position when the telescoping platform assembly is in the extended position.

15. The packaging system according to claim 14 wherein the flap member includes:

(a) a flap guide slot formed in the flap member, and aligned with the guide mount slot.

* * * * *